US009481511B2

(12) United States Patent
Yu

(10) Patent No.: US 9,481,511 B2
(45) Date of Patent: Nov. 1, 2016

(54) SILO DE-BRIDGING DEVICE INCLUDING A SLEEVE STRUCTURE HAVING A CAM CONTOUR SURFACE

(76) Inventor: Hongyan Yu, Beijing (CN)

( * ) Notice: Subject to any disclaimer, the term of this patent is extended or adjusted under 35 U.S.C. 154(b) by 684 days.

(21) Appl. No.: 13/995,388

(22) PCT Filed: Dec. 22, 2010

(86) PCT No.: PCT/CN2010/080118

§ 371 (c)(1),
(2), (4) Date: Jul. 29, 2013

(87) PCT Pub. No.: WO2012/083531

PCT Pub. Date: Jun. 28, 2012

(65) Prior Publication Data

US 2013/0302117 A1 Nov. 14, 2013

(51) Int. Cl.
*B01F 7/00* (2006.01)
*B65D 88/68* (2006.01)

(52) U.S. Cl.
CPC ..... *B65D 88/68* (2013.01); *B01F 7/00183* (2013.01)

(58) Field of Classification Search
CPC ..... B01F 7/00183; B01F 2015/0269; B01F 15/0288; B65D 88/68
USPC ..... 366/194–196, 285–286, 325.2, 325.5; 414/301
See application file for complete search history.

(56) References Cited

U.S. PATENT DOCUMENTS 1,851,044 A * 3/1932 Genovesi ..... A47F 1/035 222/185.1
2,042,739 A * 6/1936 Smith ..... B65D 88/68 222/228
2,228,421 A * 1/1941 Taylor ..... B01F 7/00066 15/104.14
2,532,238 A * 11/1950 Malke ..... B65D 88/68 222/406
2,554,109 A * 5/1951 Langhurst ..... C11B 1/10 34/73
2,561,258 A * 7/1951 Wolf ..... B01F 7/00066 222/406
2,576,620 A * 11/1951 Martin ..... B65D 88/68 222/228
2,609,185 A * 9/1952 Eisner ..... B65D 88/72 366/102
3,037,713 A * 6/1962 Carroll ..... B02C 13/26 222/228
3,038,643 A * 6/1962 Van Der Lely ..... A01C 17/00 222/227
3,048,409 A * 8/1962 Elwick ..... A01C 3/06 172/45
3,138,300 A * 6/1964 Rintala ..... B65D 88/68 222/228
3,212,672 A * 10/1965 Kromhout ..... G01F 23/00 222/185.1

(Continued)

FOREIGN PATENT DOCUMENTS

CN 2016149 U 5/1991
CN 1267625 A 9/2000

(Continued)

OTHER PUBLICATIONS

International Search Report mailed Sep. 1, 2011 for PCT/CN2010/080118, 6 pages.

(Continued)

*Primary Examiner* — Charles Cooley

(57) ABSTRACT

A silo de-bridging device (100), comprising: a rotary shaft (11) and at least one de-bridging unit (10) connected to the rotary shaft (11); each de-bridging unit (10) includes a fixed sleeve (101), a movable sleeve (102) and at least one de-bridging arm (103) connected to the movable sleeve (102), and a cam structure is formed between two end surfaces of the movable sleeve (102) and the fixed sleeve (101) adjoining each other. The silo de-bridging device can de-bridge the materiel in the silo effectively.

12 Claims, 11 Drawing Sheets

(56) References Cited

U.S. PATENT DOCUMENTS

| | | | | | |
|---|---|---|---|---|---|
| 3,223,290 | A * | 12/1965 | Schuld | A01K 5/0225 | 222/185.1 |
| 3,251,512 | A * | 5/1966 | Irving | B65D 88/68 | 222/227 |
| 3,329,410 | A * | 7/1967 | Rothert | B01F 7/00208 | 159/43.1 |
| 3,392,922 | A * | 7/1968 | Lindgren | A01C 3/063 | 222/239 |
| 3,406,914 | A * | 10/1968 | Lepp | A01C 3/063 | 239/658 |
| 3,424,350 | A * | 1/1969 | Herr | A01F 25/2018 | 222/152 |
| 3,556,413 | A * | 1/1971 | Lindgren | A01C 3/063 | 222/239 |
| 3,602,394 | A * | 8/1971 | McCune | B65D 88/68 | 222/240 |
| 3,710,960 | A * | 1/1973 | Stauffer | A01F 25/2018 | 222/227 |
| 3,710,986 | A * | 1/1973 | Lepley | B65D 90/10 | 222/185.1 |
| 3,828,946 | A * | 8/1974 | Lepley | B65D 88/68 | 222/227 |
| 3,828,947 | A * | 8/1974 | Lepley | B65D 88/68 | 222/228 |
| 3,837,507 | A * | 9/1974 | Lepley | B65D 88/68 | 222/228 |
| 3,907,131 | A * | 9/1975 | Lepley | B65D 88/68 | 222/227 |
| 3,923,204 | A * | 12/1975 | Kato | B65D 88/68 | 222/228 |
| 3,942,656 | A * | 3/1976 | Lepley | B65D 88/68 | 414/325 |
| 4,097,001 | A * | 6/1978 | Brackbill | A01C 3/063 | 239/658 |
| 4,160,514 | A * | 7/1979 | Taupin | B65D 88/68 | 222/228 |
| 4,171,165 | A * | 10/1979 | Card | B01F 7/08 | 222/236 |
| 4,217,996 | A * | 8/1980 | Good | B01F 5/24 | 222/404 |
| 4,266,901 | A * | 5/1981 | Schuette | B65D 88/68 | 414/305 |
| 4,363,428 | A * | 12/1982 | Kruger | B65D 88/68 | 222/227 |
| 4,451,004 | A * | 5/1984 | Ostergren | A01C 3/063 | 239/658 |
| 4,571,138 | A * | 2/1986 | Farajun | B08B 9/087 | 414/323 |
| 4,611,921 | A * | 9/1986 | Patel | B01F 15/0298 | 198/533 |
| 4,620,795 | A * | 11/1986 | Diebold | B65D 88/68 | 222/228 |
| 4,657,402 | A * | 4/1987 | Dupuis | B65D 88/68 | 222/228 |
| 4,957,404 | A * | 9/1990 | Lepley | B01F 7/00066 | 222/228 |
| 5,348,195 | A | 9/1994 | Pajot | | |
| 5,411,331 | A * | 5/1995 | Griffin | B65D 88/68 | 222/228 |
| 5,516,009 | A * | 5/1996 | Kautz | B01F 7/04 | 222/238 |
| 5,931,610 | A * | 8/1999 | Rixom | B01F 7/30 | 222/58 |
| 6,123,486 | A * | 9/2000 | Wilms | B65D 88/68 | 222/237 |
| 6,237,815 | B1 * | 5/2001 | Schlosser | B65B 39/004 | 222/241 |
| 2013/0302117 | A1 * | 11/2013 | Yu | B65D 88/68 | 414/301 |

FOREIGN PATENT DOCUMENTS

| | | | | | |
|---|---|---|---|---|---|
| CN | 2446094 | | | 9/2001 | |
| CN | 201010250 | | | 1/2008 | |
| CN | 201399844 | Y | | 2/2010 | |
| CN | 201961725 | U | | 9/2011 | |
| DE | 1280157 | B | * | 10/1968 | B65D 88/68 |
| DE | 2143760 | A1 | * | 3/1973 | B65D 88/68 |
| FR | 2207077 | A1 | * | 6/1974 | B65D 88/68 |
| FR | 2451329 | A1 | * | 10/1980 | B01F 7/00066 |
| JP | 6186320 | A | | 5/1986 | |
| JP | 2005169270 | A | | 6/2005 | |
| SU | 668859 | A1 | | 6/1979 | |
| SU | 793877 | A1 | | 1/1981 | |
| WO | WO 2015010247 | A1 | * | 1/2015 | B65G 65/46 |
| WO | 2015/131774 | A1 | * | 9/2015 | |

OTHER PUBLICATIONS

Australian Office Action mailed Mar. 13, 2014 for corresponding Application No. AU 2010366220, 3 pages.

Canadian Office Action mailed Dec. 23, 2014 for corresponding Application No. CA 2822154, 3 pages.

Extended European Search Report mailed Jun. 4, 2014 for corresponding Application No. EP 10860967.8, 6 pages.

Chinese Search Report mailed Apr. 1, 2013 for corresponding Application No. CN 2010106016217, 4 pages.

* cited by examiner

SILO DE-BRIDGING DEVICE INCLUDING A SLEEVE STRUCTURE HAVING A CAM CONTOUR SURFACE

TECHNICAL FIELD

The present invention relates to a silo for storing material, and particularly, to a silo de-bridging device.

BACKGROUND

When a silo outputs the stored material to the outside, a bridged camber surface having a dome shape will be easily formed in the silo, which presents the material from flowing downwards and hinders the normal output of the material. How to de-bridge so that the material can be outputted smoothly is always a difficulty attracting people's attention. Current existing de-bridging devices mainly adopt the modes such as vibration de-bridging and pneumatic de-bridging. The vibration de-bridging activates the material in the silo through the vibration of a vibrator, so as to reduce the shear stress between the materials and the friction between the material and silo walls, thereby promoting the flow and the output of the material. The pneumatic de-bridging mounts some compressed air nozzles in the silo, aligns them with the areas where a bridge is easily formed, and sprays the compressed air towards the bridged material so that it collapses, thereby achieving the object of de-bridging. The two modes have a certain de-bridging effect on the dry powder material or the material having a good dispersion. However, for a material having a high humidity or viscosity, such as the biologic material, the bridging of the material will be more solid after the vibration. In addition, the pneumatic de-bridging produces a weak power while providing much air into the silo, which also cannot really produce the de-bridging effect.

Therefore, it is necessary to provide a silo de-bridging device, so as to overcome the defects of the existing de-bridging devices, and meet the de-bridging requirements of various materials.

SUMMARY

The object of the present invention is to provide a silo de-bridging device capable of performing an effective de-bridging of the material in the silo, so that the material in the silo flows smoothly.

The above object of the present invention can be achieved through a silo de-bridging device, comprising: a rotary shaft rotatably supported in a silo and disposed in an axial direction of the silo, having an input end connected to a drive mechanism and driven by the drive mechanism to rotate; and at least one de-bridging unit connected to the rotary shaft, each de-bridging unit comprising: a fixed sleeve fixedly sleeving on the rotary shaft and being driven by the rotary shaft to rotate; a movable sleeve moveably sleeving on the rotary shaft, wherein one of two end surfaces of the movable sleeve and the fixed sleeve adjoining each other is formed as an end surface cam contour, and the other is provided with an abutting member that abuts against the end surface cam contour, the end surface cam contour coordinates with the abutting member to constitute an end surface cam structure, so that the movable sleeve is moveable to and fro in the axial direction of the silo when the fixed sleeve and the movable sleeve rotate relative to each other; and at least one de-bridging arm having one end connected to the movable sleeve, and the other end extending to a position close to an inner wall of the silo in a radial direction of the silo.

In an optional example of the present invention, the two end surfaces of the movable sleeve and the fixed sleeve adjoining each other may be formed as end surface cam contours concave-convex fitted with each other, and a protrusion of one of the end surface cam contours may be formed as the abutting member.

In another optional example of the present invention, the abutting member may be a contact protrusion protruding from the end surface of the movable sleeve or the end surface of the fixed sleeve.

In still another optional example of the present invention, the abutting member may be a roller structure.

In an optional example of the end surface cam contour of the present invention, the end surface cam contour may be a sine curve of at least one cycle after being deployed.

In another optional example of the end surface cam contour of the present invention, the end surface cam contour may include at least one V-groove contour.

In an optional example, the axial direction of the silo may be a vertical direction, and the movable sleeve may be located above the fixed sleeve.

In an optional example of the present invention, each de-bridging unit may be further provided with an elastic pushing device applying to the movable sleeve a pushing force towards the fixed sleeve.

In a specifically embodied structure of the above example, the elastic pushing device may comprise a fixed retainer connected to the rotary shaft, and an elastic member abutting between the fixed retainer and the movable sleeve.

In a specific example, the elastic member may be a compression spring.

For the silo de-bridging device having at least two de-bridging units, the sub arms at the ends of the de-bridging arms of the neighboring de-bridging units may be disposed alternatively in the radial direction of the silo.

The rotary shaft of the silo de-bridging device of the present invention may be rotatably supported in the silo through a rotary shaft centering frame.

In the silo de-bridging device of the present invention, when the silo outputs a material to the outside, the fixed sleeve of the de-bridging unit is driven by the rotary shaft to rotate. When the material encounters a small resistance, no relative movement occurs between the movable sleeve and the fixed sleeve, and the movable sleeve drives the de-bridging arm thereon to rotate along with the fixed sleeve. When the resistance to the material increases, the rotation of the movable sleeve is hindered, a relative movement occurs between the movable sleeve and the fixed sleeve, and the movable sleeve moves to and fro in the axial direction under the action of the end surface cam structure between the movable sleeve and the fixed sleeve, so as to drive the de-bridging arm thereon to move to and fro, thereby disturbing the material in the axial direction of the silo. Thus in the silo, due to the to-and-fro movement of the de-bridging arm in the axial direction, the material cannot be supported by the silo wall to form a bridged camber surface, thereby achieving an effective de-bridging of the silo. As compared with the existing vibration de-bridging and pneumatic de-bridging, the de-bridging device of the present invention has a simple structure and a low cost, and it is not limited by the humidity and viscosity of the material, so as to effectively achieve the effective silo de-bridging of many materials, particularly the biologic material.

BRIEF DESCRIPTION OF THE DRAWINGS

In order to more clearly describe the technical solutions in the prior art or the embodiments of the present invention, the drawings to be used in the descriptions of the prior art or the embodiments are briefly introduced as follows. Obviously, the following drawings just illustrate some embodiments of the present invention, and a person skilled in the art can obtain other drawings from these drawings without paying a creative effort.

DESCRIPTION OF THE EMBODIMENTS

Figure 1:
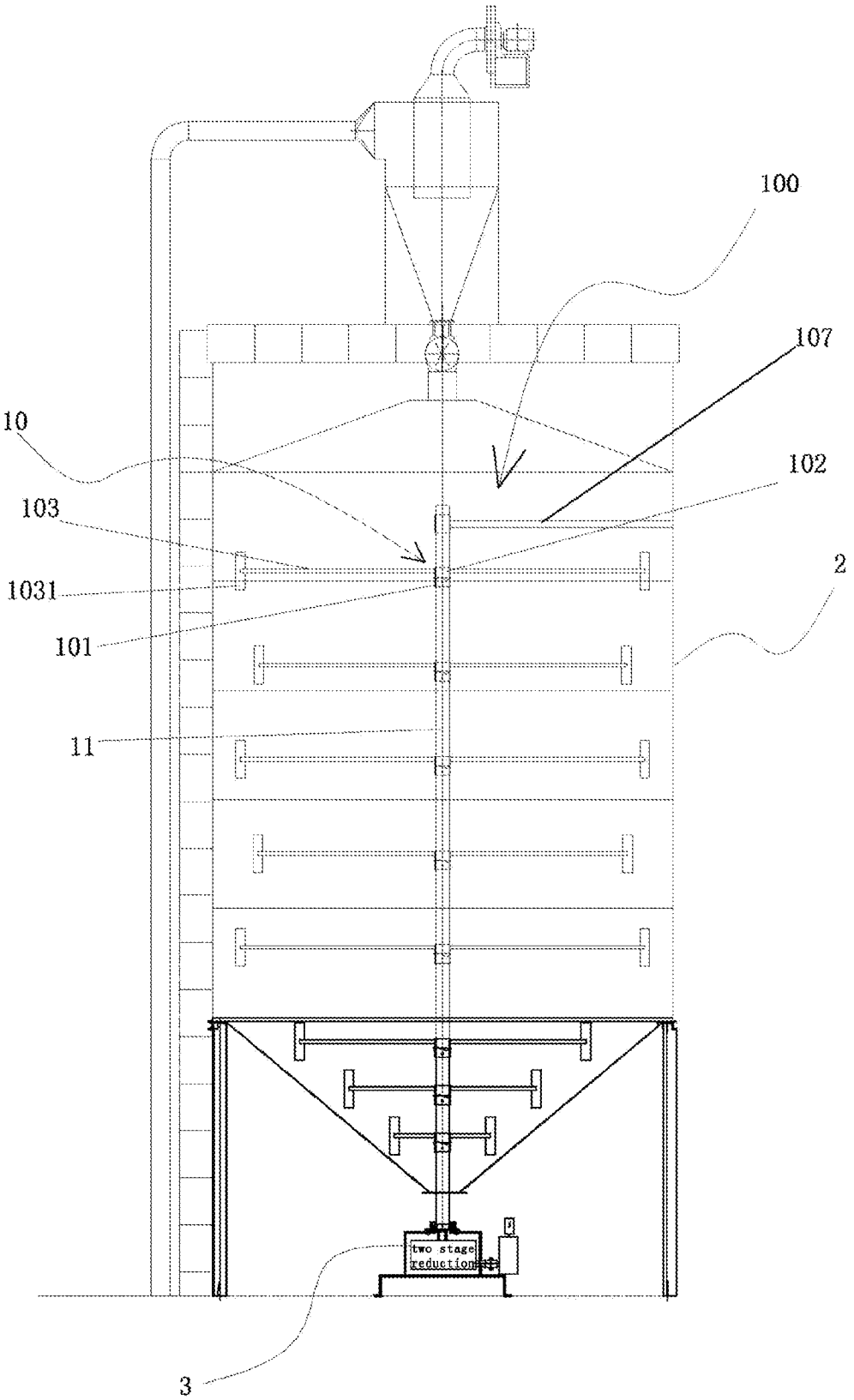
FIG. 1 is a structure diagram of a silo de-bridging device according to Embodiment 1 of the present invention.

The technical solutions of the embodiments of the present invention will be clearly and completely described as follows with reference to the drawings. Obviously, those described herein are just parts of the embodiments of the present invention rather than all the embodiments. Based on the embodiments of the present invention, any other embodiment obtained by a person skilled in the art without paying any creative effort shall fall within the protection scope of the present invention.

As illustrated in FIGS. 1-22, the present invention provides a silo de-bridging device 100 disposed in a silo 2. The de-bridging device 100 includes a rotary shaft 11 and at least one de-bridging unit 10 connected thereto, wherein the rotary shaft 11 is rotatably supported in the silo 2 and disposed in an axial direction of the silo 2, having an input end connected to a drive mechanism 3 and driven by the drive mechanism 3 to rotate. The at least one de-bridging unit 10 is connected to the rotary shaft 11, and moveable up and down or rotatable along with the rotation of the rotary shaft 11. Each de-bridging unit 10 includes a fixed sleeve 101, a movable sleeve 102 and at least one de-bridging arm 103. In which, the fixed sleeve 101 fixedly sleeves on the rotary shaft 11 and being driven by the rotary shaft 11 to rotate, and the movable sleeve 102 moveably sleeves on the rotary shaft 11. One of two end surfaces of the movable sleeve 102 and the fixed sleeve 101 adjoining each other is formed as an end surface cam contour 104, and the other is provided with an abutting member 105 moveable along the end surface cam contour 104. The end surface cam contour 104 coordinates with the abutting member 105 to constitute an end surface cam structure, so that the movable sleeve 102 is moveable to and fro in an axial direction of the silo 2 when the fixed sleeve 101 and the movable sleeve 102 rotate relative to each other. The de-bridging arm 103 has one end connected to the movable sleeve 102, and the other end extending to a position close to an inner wall of the silo in a radial direction of the silo 2.

When the silo 2 outputs a material to the outside, the fixed sleeve 101 of the de-bridging unit 10 is driven by the rotary shaft 11 to rotate. When the material encounters a small resistance, no relative movement occurs between the movable sleeve 102 and the fixed sleeve 101, and the movable sleeve 102 drives the de-bridging arm 103 thereon to rotate along with the fixed sleeve 101. When the resistance to the material increases, the rotation of the movable sleeve 102 is hindered, a relative movement occurs between the movable sleeve 102 and the fixed sleeve 101, and the movable sleeve 102 moves to and fro in the axial direction under the action of the end surface cam structure between the movable sleeve 102 and the fixed sleeve 101, so as to drive the de-bridging arm 103 thereon to move in the axial direction of the silo. Thus in the silo 2, the de-bridging arm 103 moves in the axial direction of the silo, and the material cannot be supported by the silo wall to form a bridged camber surface, thereby achieving an effective de-bridging of the silo.

In an optional example of the silo de-bridging device of the present invention, i.e., Embodiment 1 of the silo de-bridging device as illustrated in FIGS. 1-13, the axial direction of the silo 2 may be a vertical direction, and correspondingly the rotary shaft 11 is vertically disposed in the silo 2. In the embodiment, the movable sleeve 102 is disposed above the fixed sleeve 101 in each de-bridging unit, so that the abutting member 105 of the end surface cam structure between the movable sleeve 102 and the fixed sleeve 101 always abuts against the end surface cam contour 104 under the gravity, thereby enabling the movable sleeve 102 to be movable up and down along with the variation of the end surface cam contour 104. Thus when the movable sleeve 102 and the fixed sleeve 101 rotate relative to each other, the movable sleeve 102 is movable up and down under the action of the end surface cam structure, thereby driving the de-bridging arm 103 connected to the movable sleeve 102 to move up and down to disturb the material in the silo up and down. Particularly, under the disturbance of the de-bridging arm 103, the material close to the inner wall of the silo cannot be supported by the inner wall of the silo and thus can not be bridged, so that the material can flow smoothly, and an effective de-bridging of the silo can be achieved.

As illustrated in FIGS. 14-22, in another optional example of the silo de-bridging device of the present invention, i.e., Embodiment 2 of the silo de-bridging device, each de-bridging unit 10 is further provided with an elastic pushing device 106 that applies to the movable sleeve 102 a pushing force towards the fixed sleeve 101, so that through an elastic pushing from the elastic pushing device 106 to the movable sleeve, the abutting member 105 of the end surface cam structure between the movable sleeve 102 and the fixed sleeve 101 always abuts against the end surface cam contour 104, and the movable sleeve 102 is movable to and fro in the axial direction of the silo 2 along with the variation of the end surface cam contour 104. Thus, when the movable sleeve 102 and the fixed sleeve 101 rotate relative to each other, the movable sleeve 102 can drive the connected de-bridging arm 103 to move to and fro in the axial direction of the silo 2 to axially disturb the material in the silo 2. Particularly, under the axial disturbance of the de-bridging arm 103, the material close to the inner wall of the silo cannot be supported by the inner wall of the silo and thus can not be bridged, so that the material can flow smoothly, and an effective de-bridging of the silo can be achieved.

Figure 23:
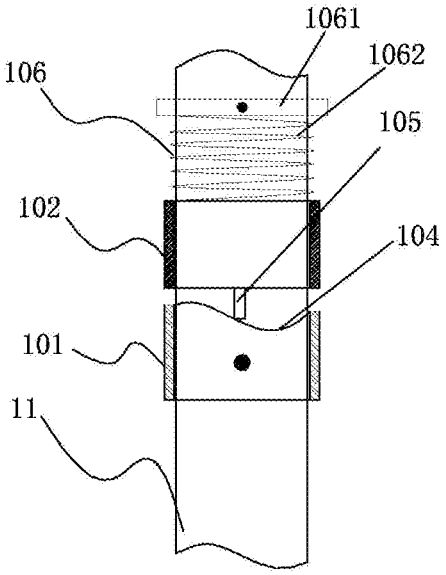
FIGS. 23-24 are schematic diagrams of two other modifications to Embodiment 2 of the present invention.
Figure 24:
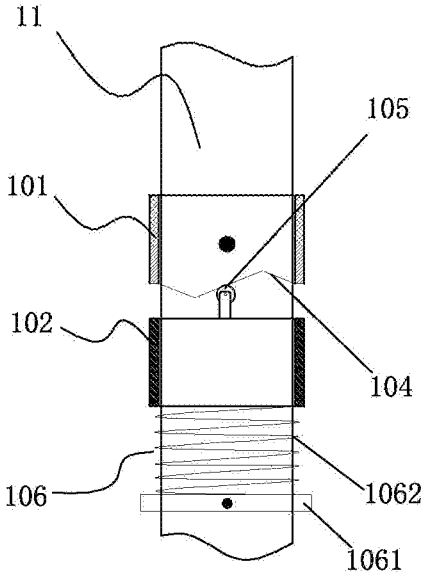

The embodiment 2 of the present invention ensures abutment between the abutting member of the end surface cam structure and the end surface cam contour through the elastic pushing device, without utilizing the gravity, thus as illustrated in FIGS. 14-22, it can be applied in the silo 2 whose axial direction is the horizontal direction, or a silo having its axial direction in a certain angle with the horizontal direction, e.g., a silo placed on a transport vehicle. In addition, the silo de-bridging unit 10 having the elastic pushing device 106 may also be applied in a situation where the axial direction of the silo 2 is the vertical direction, the material bears a very large resistance, and it is difficult for the abutting member of the end surface cam structure to always abut against the end surface cam contour 104 under the gravity, as illustrated in FIG. 23. As illustrated in FIG. 24, the silo de-bridging unit 10 having the elastic pushing device 106 may also be applied in an example where the axial direction of the silo 2 is the vertical direction and the movable sleeve 102 is located below the fixed sleeve 101.

In a specific example of the elastic pushing device 106 of the de-bridging unit 10 of the present invention, the elastic pushing device 106 may include a fixed retainer 1061 connected to the rotary shaft 11, and an elastic member 1062 abutting between the fixed retainer 1061 and the movable sleeve 102. The elastic member 1062 specifically may be a compression spring.

As illustrated in FIGS. 3-5 and 15-16, in an optional example of the end surface cam structure of the present invention, two end surfaces of the movable sleeve 102 and the fixed sleeve 101 adjoining each other are formed as end surface cam contours concave-convex fitted with each other, and a protrusion of one of the end surface cam contours is formed as the abutting member 105 of the end surface cam structure.

As illustrated in FIGS. 3-7, 12-13 and 15-16, as an optional example of the end surface cam contour 104 of the end surface cam structure of the present invention, the end surface cam contour 104 may be a sine curve of at least one cycle after being deployed. The end surface cam contour 104 using the sine curve enables the end surface cam structure formed between the fixed sleeve 101 and the movable sleeve 102 to move stably during the rotation of the rotary shaft 11. The cycle of the sine curve actually reflects the concave-convex variations on the end surface cam structure, i.e., the number of times of the to and fro movements of the movable sleeve 102 in the axial direction once the rotary shaft 11 rotates for a circle, and the number of the cycles may be selected according to the material condition, the silo size, etc.

As illustrated in FIGS. 9-11 and 21-22, as another optional example of the end surface cam contour 104 of the end surface cam structure of the present invention, the end surface cam contour 104 may include at least one V-groove contour. The structure of such end surface cam contour 104 is easy to be machined with a low cost.

Although only a few examples of the end surface cam contour 104 are given above, a person skilled in the art shall appreciate that the above examples are just exemplary, and the end surface cam contour 104 is not limited thereto, provided that the end surface cam contour 104 enables the movable sleeve 102 to be moveable to and fro in the axial direction of the silo 2 when the movable sleeve 102 and the fixed sleeve 101 rotate relative to each other. The present invention may be implemented using many existing end surface cam contours, which are omitted herein.

As illustrated in FIGS. 6-9, 11-12 and 17-19, as an optional example of the abutting member 105 of the end surface cam structure of the present invention, the abutting member 105 may be a contact protrusion protruding from the end surface of the movable sleeve 102 or the end surface of the fixed sleeve 101. An end of the contact protrusion abuts against the end surface cam contour 104, so that the movable sleeve 102 moves to and fro in the axial direction of the silo 2 along with the variation of the end surface cam contour, when the movable sleeve 102 rotates relative to the fixed sleeve 101.

As illustrated in FIGS. 10, 13 and 20-22, in another optional example of the abutting member 105 of the end surface cam structure of the present invention, the abutting member 105 may be a roller structure, whose roller abuts against the end surface cam contour 104, so that the movable sleeve 102 moves to and fro in the axial direction of the silo 2 along with the variation of the end surface cam contour, when the movable sleeve 102 rotates relative to the fixed sleeve 101.

Although only a few examples of the abutting member 105 are given above, a person skilled in the art shall appreciate that the above examples are just exemplary, and the abutting member 105 is not limited thereto, provided that the abutting member 105 abuts against the end surface cam contour 104, so that the end surface cam structure enables the movable sleeve 102 to be moveable to and fro in the axial direction of the silo 2 when the movable sleeve 102 and the fixed sleeve 101 rotate relative to each other. The specific structure of the abutting member 105 may not be limited.

In optional examples of the end surface cam structure of the present invention, as illustrated in FIGS. 6-10, 17-20 and 22, the end surface cam contour 104 may be formed on the end surface of the fixed sleeve 101, and the abutting member 105 may be formed on the end surface of the movable sleeve 102. Or, as illustrated in FIGS. 11-13 and 21, the abutting member 105 abutting against the end surface cam contour 104 may be formed on the end surface of the fixed sleeve 101, and the end surface cam contour 104 may be formed on the movable sleeve 102.

Figure 14:
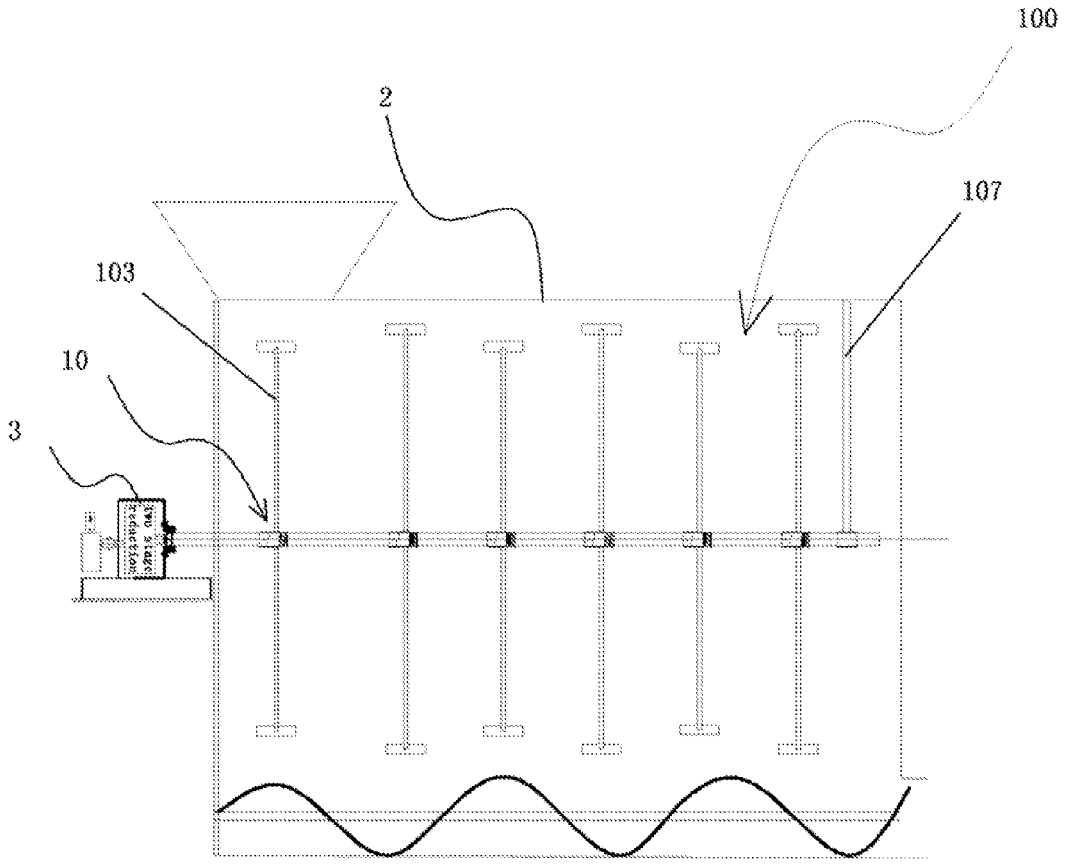
FIG. 14 is a structure diagram of a silo de-bridging device according to Embodiment 2 of the present invention.
Figure 15:
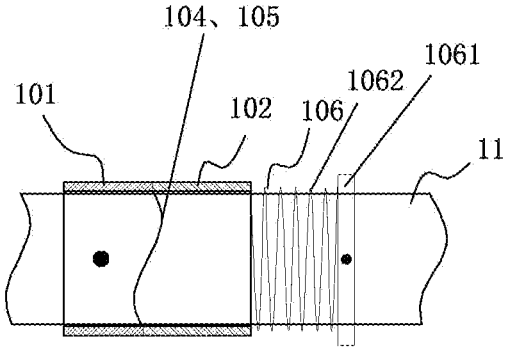
FIG. 15 is a schematic diagram of a fitting condition of an end surface cam structure of a de-bridging unit according to Embodiment 2 of the present invention.
Figure 16:
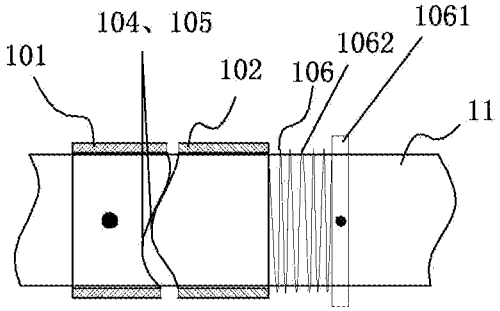
FIG. 16 is a schematic diagram of another fitting condition of the end surface cam structure of the de-bridging unit according to Embodiment 2 of the present invention.
Figure 17:
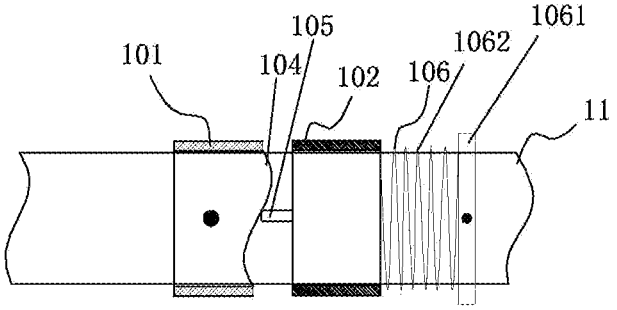
FIG. 17 is a schematic diagram of a fitting condition of another end surface cam structure of the de-bridging unit according to Embodiment 2 of the present invention.
Figure 18:
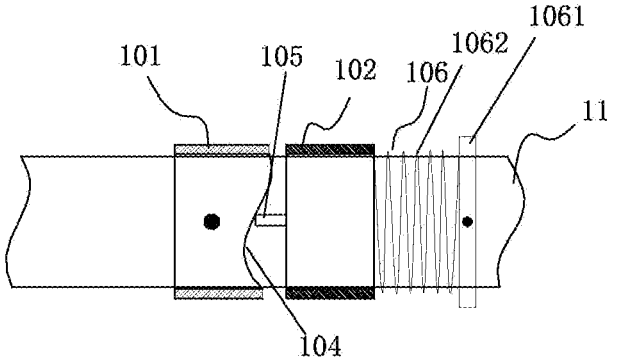
FIG. 18 is a schematic diagram of another fitting location of the another end surface cam structure of the de-bridging unit according to Embodiment 2 of the present invention.
Figure 19:
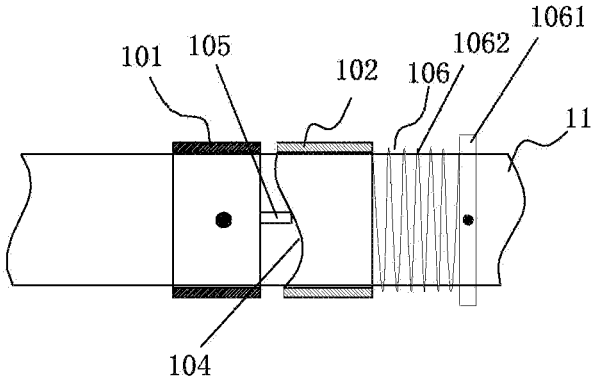
FIGS. 19-22 are schematic diagrams of several other end surface cam structures of the de-bridging unit according to Embodiment 2 of the present invention.
Figure 20:
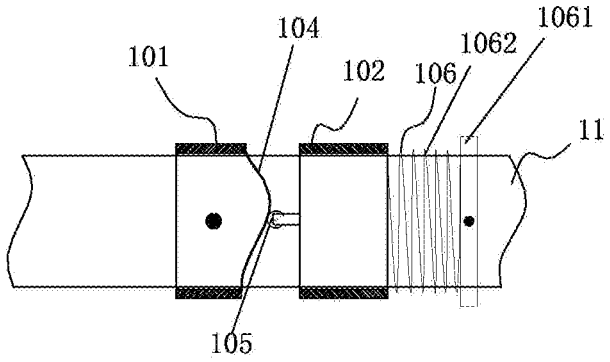
Figure 21:
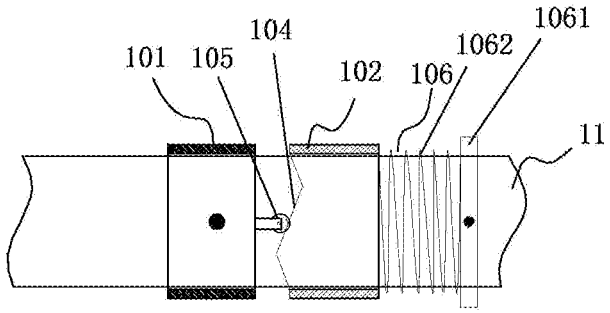
Figure 22:
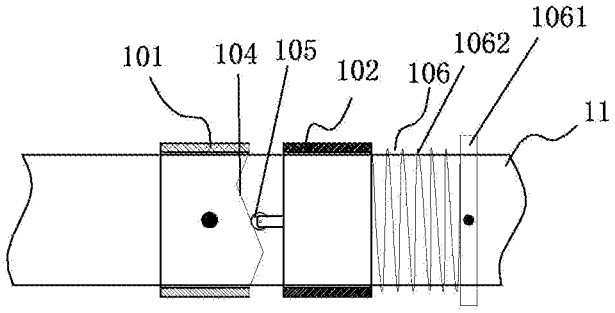

As illustrated in FIGS. 1 and 14, an end of the de-bridging arm 103 close to the inner wall of the silo may be further provided with a sub arm 1031 extending in the axial direction of the silo 2, so as to improve the de-bridging effect. Upon the actual demand, the de-bridging arm 103 may be provided with a plurality of sub arms 1031 extending in the axial direction, so as to improve the de-bridging effect.

In the present invention, in an optional example, the de-bridging arm 103 may be fixedly connected to the movable sleeve 102. In another optional example, the de-bridging arm 103 may be hinged to the movable sleeve 102, and provided with a limiting structure for limiting the action angle of the de-bridging, e.g., limiting that the de-bridging arm 103 shall act in a range not more than 15 degrees.

For the silo de-bridging device 100 having at least two de-bridging units 10, the sub arms 1031 at the ends of the de-bridging arms 103 of the neighboring de-bridging units 10 may be disposed alternatively in the radial direction of the silo 2, so as to prevent friction between the sub arm 1031 and the inner wall of the silo due to the uneven wall surface of the silo 2.

In the present invention, the number of the de-bridging units 10 and the number of the de-bridging arms 103 in each de-bridging unit may be selected upon demand according to height, diameter and material condition of the silo.

Figure 2:
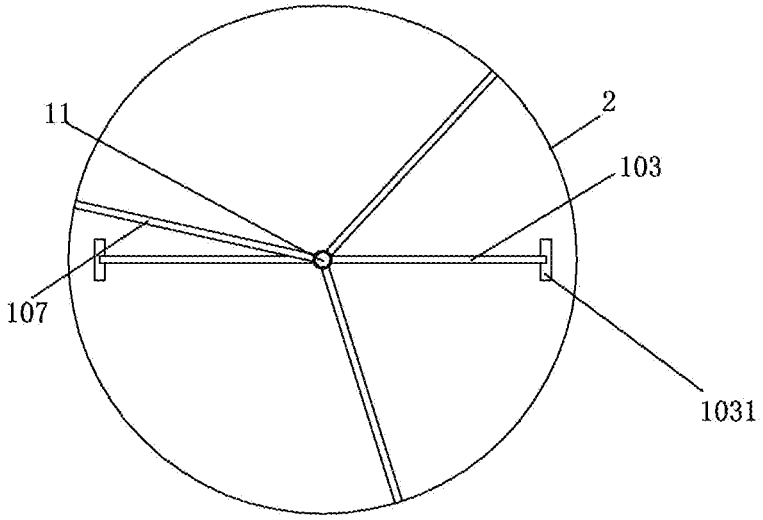
FIG. 2 is a top-viewed structure diagram of the silo de-bridging device according to Embodiment 1 of the present invention.
Figure 3:
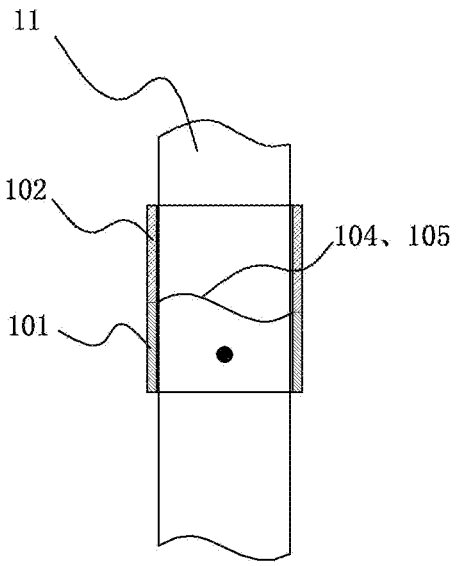
FIG. 3 is a schematic diagram of an end surface cam structure of a movable sleeve and a fixed sleeve according to Embodiment 1 of the present invention, wherein end surface cam contours of the movable sleeve and the fixed sleeve are completely concave-convex fitted with each other.
Figure 4:
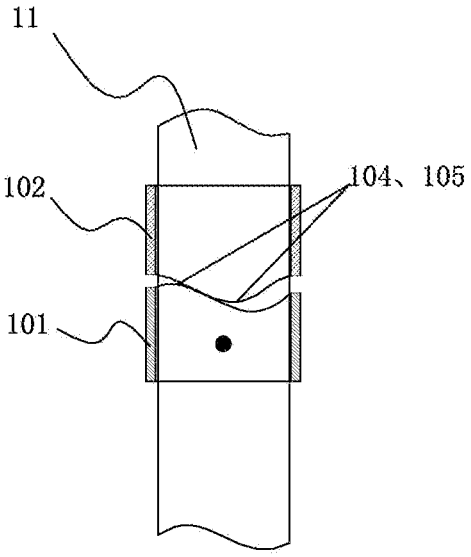
FIG. 4 is another schematic diagram of the end surface cam structure of the movable sleeve and the fixed sleeve according to Embodiment 1 of the present invention, wherein the movable sleeve has moved axially after the movable sleeve and the fixed sleeve rotate relative to each other.
Figure 5:
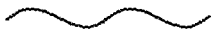
FIG. 5 is a deployed diagram of a cam contour of an end surface cam structure of a de-bridging unit according to Embodiment 1 of the present invention.
Figure 6:
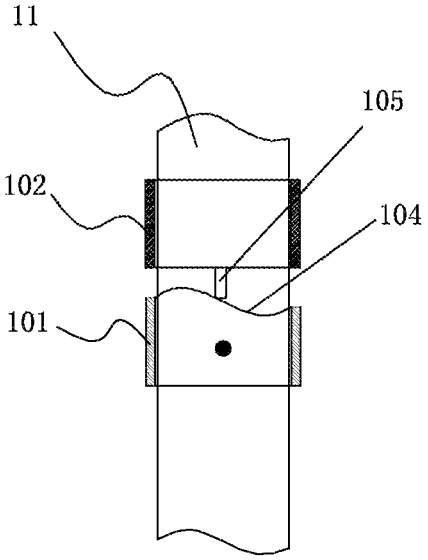
FIG. 6 is a schematic diagram of a fitting condition of another end surface cam structure of the de-bridging unit according to Embodiment 1 of the present invention.
Figure 7:
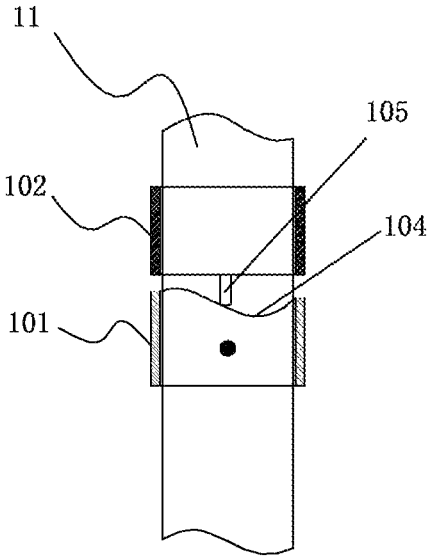
FIG. 7 is a schematic diagram of another fitting condition of the another end surface cam structure of the de-bridging unit according to Embodiment 1 of the present invention.
Figure 8:
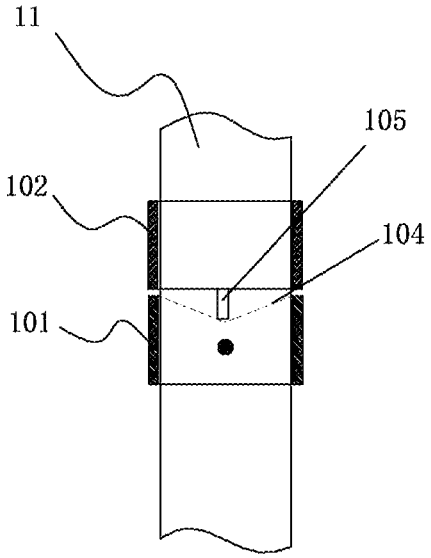
FIG. 8 is a schematic diagram of a fitting condition of still another end surface cam structure of the de-bridging unit according to Embodiment 1 of the present invention.
Figure 9:
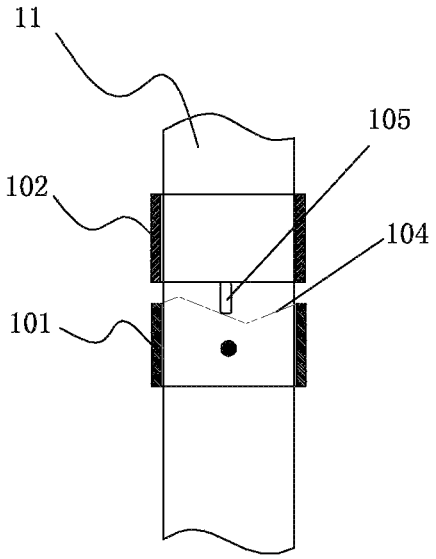
FIG. 9 is a schematic diagram of another fitting condition of the still another end surface cam structure of the de-bridging unit according to Embodiment 1 of the present invention.
Figure 10:
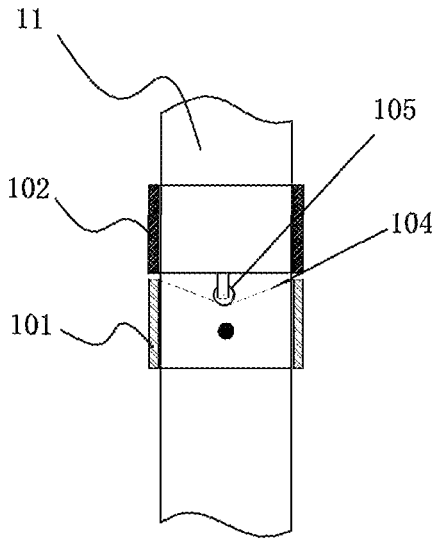
FIGS. 10-13 are schematic diagrams of several other end surface cam structures of the de-bridging unit according to Embodiment 1 of the present invention.
Figure 11:
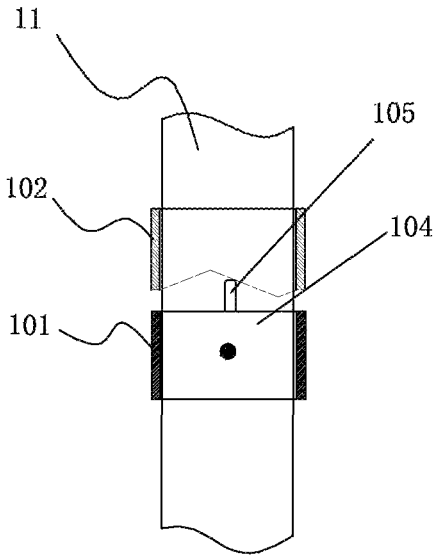
Figure 12:
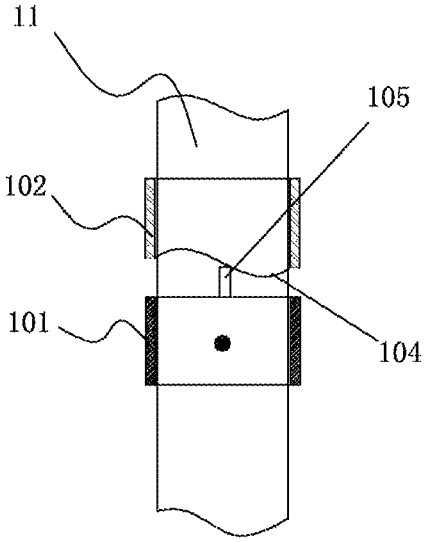
Figure 13:
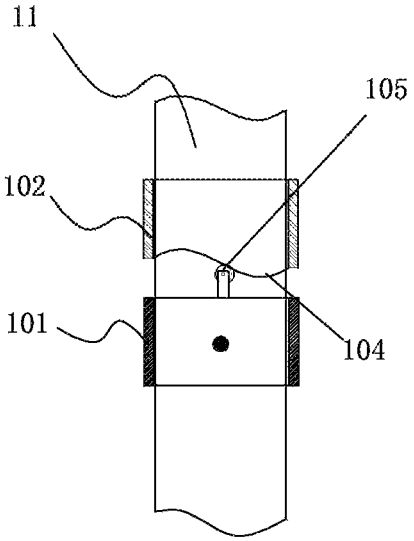

As illustrated in FIGS. 1-2, the rotary shaft 11 of the silo de-bridging device 100 of the present invention may be rotatably supported in the silo 2 through a rotary shaft centering frame 107.

The examples shown in FIGS. 1-24 just illustrate a few embodiments, and the present invention is not limited thereto. Upon demand, a person skilled in the art may obtain various different embodiments through permutation and combination of different features, such as the positions of the end surface cam contour 104, the abutting member 105 of the end surface cam structure, and the movable sleeve 102 and the fixed sleeve 101 in the de-bridging device, the axial direction of the silo 2, the arrangement of the elastic pushing device 106, which are omitted herein.

The above descriptions of the present invention are just exemplary, thus various modifications not deviating from the main idea of the present invention shall fall within the scope of the present invention, and those modifications shall not be deemed as deviating from the spirit and scope of the present invention.

What is claimed is:

1. A silo de-bridging device to be disposed in a silo, the silo de-bridging device comprising:

a rotary shaft rotatably supported in the silo and disposed in an axial direction of the silo, having an input end connected to a drive mechanism and driven by the drive mechanism to rotate; and at least one de-bridging unit connected to the rotary shaft; wherein each de-bridging unit comprising:

a fixed sleeve fixedly sleeving on the rotary shaft and being driven by the rotary shaft to rotate;

a movable sleeve moveably sleeving on the rotary shaft, wherein one of two axial end surfaces of the movable sleeve and the fixed sleeve adjoining each other is formed as an end surface cam contour, and the other is provided with an abutting member that abuts against the end surface cam contour; the end surface cam contour coordinates with the abutting member to constitute an end surface cam structure, so that the movable sleeve is moveable to and fro in the axial direction of the silo when the fixed sleeve and the movable sleeve rotate relative to each other; and at least one de-bridging arm having one end connected to the movable sleeve, and the other end extending to a position close to an inner wall of the silo in a radial direction of the silo.

2. The silo de-bridging device according to claim 1, wherein the two end surfaces of the movable sleeve and the fixed sleeve adjoining each other are formed as end surface cam contours concave-convex fitted with each other, and a protrusion of one of the end surface cam contours is formed as the abutting member.

3. The silo de-bridging device according to claim 1, wherein the abutting member is a contact protrusion protruding from the end surface of the movable sleeve or the end surface of the fixed sleeve; or the abutting member is a roller structure.

4. The silo de-bridging device according to claim 1, wherein the end surface cam contour is a sine curve of at least one cycle after being deployed.

5. The silo de-bridging device according to claim 1, wherein the end surface cam contour includes at least one V-groove contour.

6. The silo de-bridging device according to claim 1, wherein the axial direction of the silo is a vertical direction, and in each de-bridging unit, the movable sleeve is located above the fixed sleeve.

7. The silo de-bridging device according to claim 1, wherein each de-bridging unit is further provided with an elastic pushing device applying to the movable sleeve a pushing force towards the fixed sleeve.

8. The silo de-bridging device according to claim 7, wherein the elastic pushing device comprises a fixed retainer connected to the rotary shaft, and an elastic member abutting between the fixed retainer and the movable sleeve.

9. The silo de-bridging device according to claim 8, wherein the elastic member is a compression spring.

10. The silo de-bridging device according to claim 1, wherein an end of the de-bridging arm close to the inner wall of the silo is provided with a sub arm extending in the axial direction of the silo.

11. The silo de-bridging device according to claim 10, wherein the silo de-bridging device has at least two de-bridging units, and the sub arms at the ends of the de-bridging arms of the neighboring de-bridging units are disposed alternatively in the radial direction of the silo.

12. The silo de-bridging device according to claim 1, wherein the rotary shaft is rotatably supported in the silo through a rotary shaft centering frame.

* * * * *